US008757380B2

(12) United States Patent
Loftin

(10) Patent No.: US 8,757,380 B2
(45) Date of Patent: Jun. 24, 2014

(54) EXTENDED GLUE STRIPS FOR SECURING CARTONS

(75) Inventor: Caleb S Loftin, Richmond, VA (US)

(73) Assignee: Meadwestvaco Packaging Systems, LLC, Richmond, VA (US)

( * ) Notice: Subject to any disclaimer, the term of this patent is extended or adjusted under 35 U.S.C. 154(b) by 52 days.

(21) Appl. No.: 13/272,194

(22) Filed: Oct. 12, 2011

(65) Prior Publication Data

US 2012/0273379 A1 Nov. 1, 2012

Related U.S. Application Data

(60) Provisional application No. 61/392,914, filed on Oct. 13, 2010.

(51) Int. Cl.
*B65D 5/28* (2006.01)

(52) U.S. Cl.
USPC ..... 206/427; 229/103.2

(58) Field of Classification Search
USPC ..... 206/427, 434; 229/103.2, 198
See application file for complete search history.

(56) References Cited

U.S. PATENT DOCUMENTS

| | | | | |
|---|---|---|---|---|
| 3,807,624 | A | 4/1974 | Funkhouserr | |
| 4,919,266 | A | 4/1990 | McIntosh | |
| 5,197,656 | A * | 3/1993 | Hoell et al. | 206/427 |
| 5,246,112 | A * | 9/1993 | Stout et al. | 206/427 |
| 2009/0277134 | A1 | 11/2009 | Jacob et al. | |

* cited by examiner

*Primary Examiner* — Steven A. Reynolds
*Assistant Examiner* — King M Chu
(74) *Attorney, Agent, or Firm* — MWV Intellectual Property Group

(57) ABSTRACT

A carton with at least one rounded corner includes a bottom panel for supporting lower ends of substantially cylindrical articles, four side panels, at least one corner panel extending from one of the opposed side edges of a first one of the four side panels, and at least one glue strip extending from the at least one corner panel. The at least one glue strip includes at least one glue tab extending from the proximal edge of the at least one glue strip. The at least one glue tab is secured in a face contacting arrangement to a second one of the four side panels so as to connect the first one of the four side panels to the second one of the four side panels.

16 Claims, 6 Drawing Sheets

EXTENDED GLUE STRIPS FOR SECURING CARTONS

CROSS REFERENCE TO A RELATED APPLICATION

This application claims priority to U.S. Provisional Application No. 61/392,914, filed Oct. 13, 2010, the entirety of which is incorporated herein by reference.

FIELD OF THE INVENTION

This invention relates generally to cartons, and more particularly, to extended glue strips for securing a carton for enclosing substantially cylindrical containers.

BACKGROUND OF THE INVENTION

Cartons for carrying multiple articles, well known in the art, are useful for transporting, storing and providing consumers access to the articles, which oftentimes, are substantially cylindrical cans or bottles.

It is advantageous for cartons to conform to the contour of the containers within, for several reasons. Squared carton corners adjacent to rounded sides of substantially cylindrical containers leave voids that permit the corners to cave in if the carton is struck from the outside. The extent of contact between the inside surfaces of the carton and the sides of a substantially cylindrical container can be increased with rounded corners that closely conform to the curvature of the container. This increased contact area also increases the friction between the container and the carton so as to reduce the tendency of the container to spin inside the carton, which can cause scuffing of container labels and surfaces.

To provide cartons with conforming corners, typical cartons instead sacrifice surface area for adhesives that hold the walls of the carton together. Most cartons have minor flaps for receiving glue or other adhesives to secure the sides of the carton. The adhesives work best when disposed between substantially flat, i.e., parallel and linear, sheets of substrate. Consequently, minor flaps can be securely adhered to flat carton panels, but adhere less securely to panels that are curved.

SUMMARY OF THE INVENTION

The present invention overcomes the shortcomings of the prior art by providing a carton for enclosing multiple substantially cylindrical beverage containers, the carton having rounded corner panels that conform to the curvature of the beverage containers, and the side panels of the carton being interconnected with glue tabs that extend the effective surface area of glue strips that extend from the corner panels. The glue tabs are struck at least in part from the corner panels.

The exemplary carton is formed of a foldable sheet material and includes a top panel, four side panels, and a bottom panel. The four side panels include two opposed side panels and two opposed end panels. The carton also includes a finger aperture formed in the top panel, which serves as a handle for lifting the carton.

Although the four side panels are disposed at right angles with respect to one another to define a substantially rectangular carton, the corners of the carton are rounded. The rounded corners are defined by four corner panels that extend from side edges of at least two of the side panels. In certain embodiments, for example, two corner panels extend from both vertical side edges of two of the side panels, while no corner panels extend from the vertical side edges of the side panels at the ends of the carton ("end panels"). In other embodiments (not shown), each of the four corner panels extends from a different one of the side panels. To encourage proper curvature, each corner panel may bear vertical scores that extend along the length of the corner panel.

The side panels are interconnected by means of a glue strip that extends from a distal edge of each corner panel. The outside surface of each glue strip is secured to the inside surface of one of the end panels, and is able to maintain a secure, substantially linear face-contacting arrangement beyond the tangent point, defined by divergence of the corner panel from the end panel, by means of a set of at least one glue tab.

The present invention also provides a blank for constructing a carton in accordance with the invention. For example, an exemplary blank includes a number of hingedly connected primary panels that extend longitudinally, i.e., along the length of the blank. The primary panels include a top panel hingedly connected to a first side panel, which is hingedly connected to the bottom panel. The bottom panel is hingedly connected to a second side panel. Two more side panels are hingedly connected to opposing longitudinal edges of the bottom panel. In the exemplary embodiments, the third and fourth side panels will hereinafter be referred to as end panels, simply to differentiate them from the first and second side panels.

An edge flap is hingedly connected along a free edge of the blank so that the primary panels can be interconnected to define a tubular sleeve having a top, a bottom, and two sides. The tubular sleeve can be fully enclosed by securing the two end panels to the corner panels that extend from the two side panels. To enable this interconnection, the exemplary blank further includes glue flaps that extend from longitudinal edges of the corner panels. The effective surface area of the glue flaps is increased by striking at least one glue tab from each corner panel, each glue tab extending continuously from a proximal edge of the glue flap.

Each glue tab extends from a proximal edge of one of the glue flaps, the proximal edge being defined by a fold line that connects the glue flap to a corner panel. The glue tab is, in part, struck from the corner panel, such that when the corner panel curves around the substantially cylindrical articles enclosed by the carton, the glue tab remains in-line with the remainder of the glue strip, and substantially parallel to the end panel to which the glue strip and glue tab will adhere. Thus, the glue tab remains in a substantially linear relationship so that it extends the face-contacting arrangement between the glue strip and an end panel between which glue can be deposited to connect it to another one of the four side panels, with much less likelihood of delaminating.

In the exemplary embodiment, each glue tab is substantially rectangular, with its base being defined along the fold line that connects the glue strip to the corner panel, and a substantially parallel distal edge with rounded corners therebetween.

The foregoing has broadly outlined some of the aspects and features of the present invention, which should be construed to be merely illustrative of various potential applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

The various embodiments will be described herein as a carton for straight cylindrical beverage containers such as aluminum cans. However, the teachings of the invention are applicable to any number of articles and containers, which may or may not be tapered and/or cylindrical, including but not limited to plastic, metallic, or glass bottles, cans, and the like.

Figure 1:
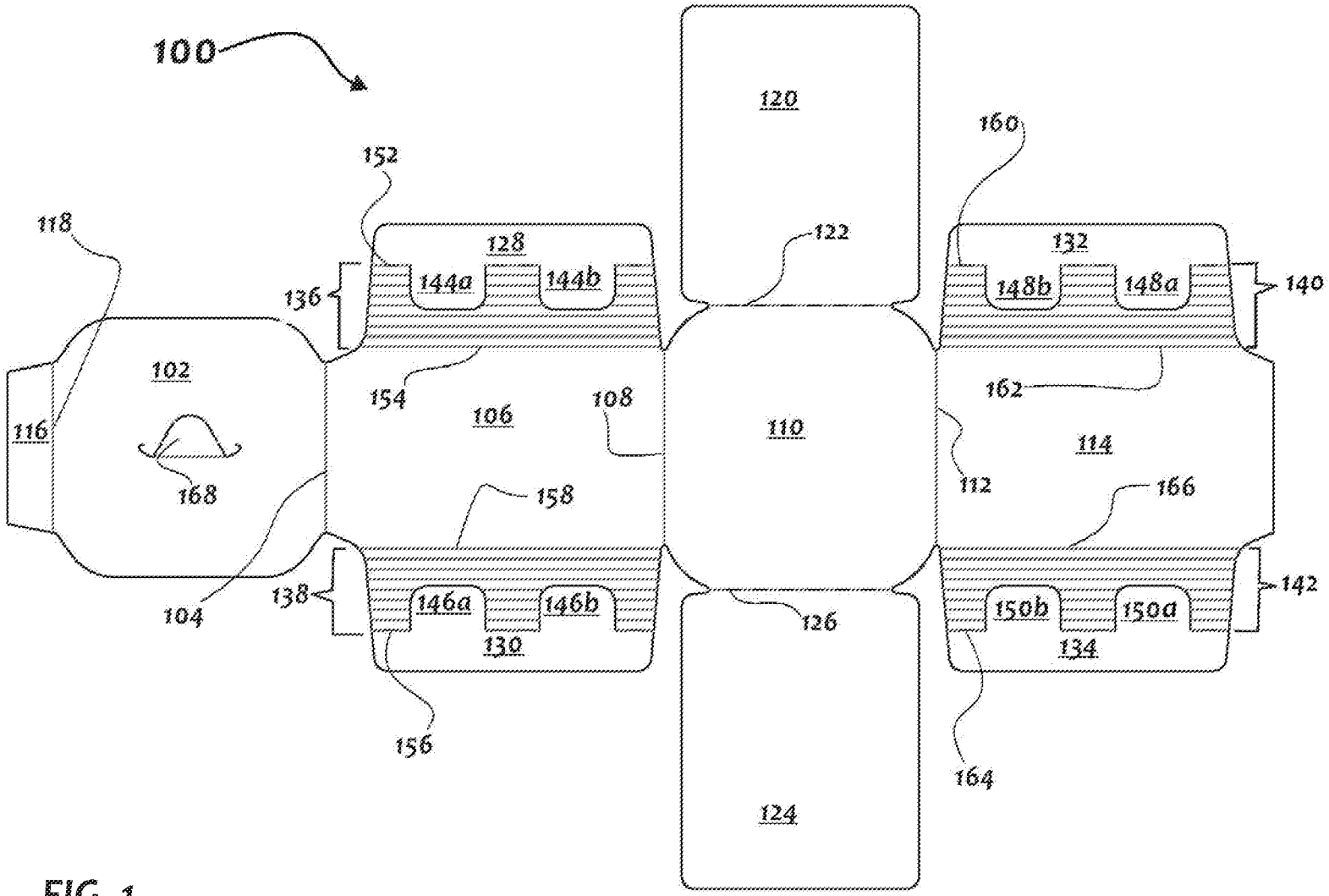
FIG. 1 is a plan view of a carton blank in accordance with an exemplary embodiment of the present invention.

Referring now to the drawings in which like numerals represent like elements throughout the several views, FIG. 1 illustrates a carton blank 100 ("blank") for forming a carton 200 that incorporates one embodiment of the glue strip extension tabs in accordance with the present invention. The blank 100 is cut from or formed as a substantially unitary or composite foldable sheet material such as paperboard, corrugated board, clear or opaque plastic, laminates, any combination thereof, or any other suitable substrate. As such, the blank 100 includes several panels that are hingedly connected to one another along transverse fold lines. The terms "fold line" and "severance line" refers to all manner of printed lines, frangible or otherwise weakened lines, perforations, a line of perforations, a line of short slits, a line of half-cuts, a single half-cut, a cut line, scored lines, slits, any combination thereof, and the like.

Figure 7:
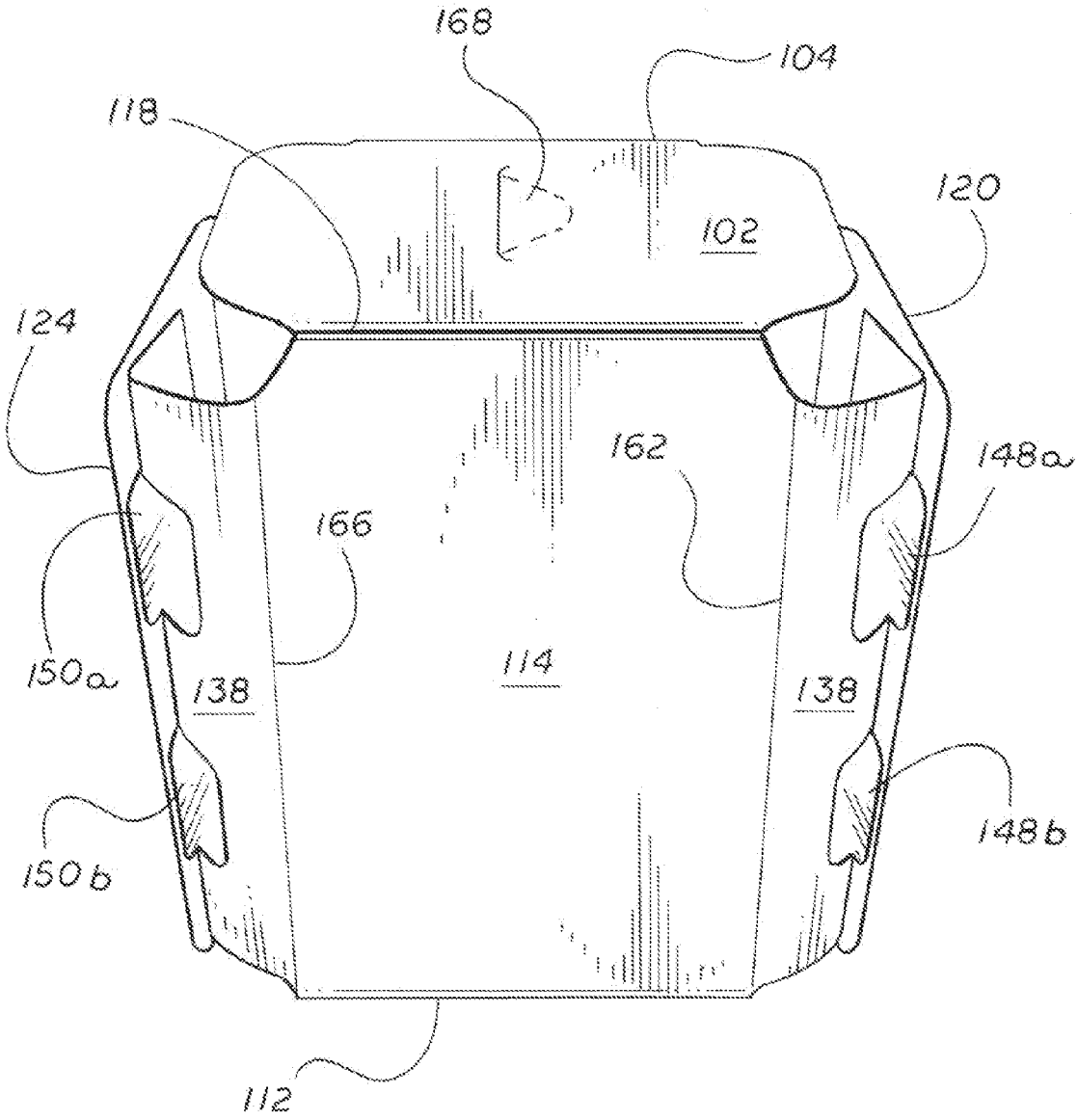
FIG. 7 is another perspective view of the carton of FIG. 2, showing a side view as opposed to the end view of FIG. 2.

More specifically, FIG. 1 is a plan view of blank 100 for forming the exemplary carton 200 (best shown in FIG. 2 and FIG. 7), with the inside surface of the blank 100 shown. The outside surface may be used as its art side for printing product information, decorative designs, and brand specific indicia, such as logos, trademarks and associated copy. The opposite side (not shown) of the blank 100 is its outside surface. Either or both the inside and outside surface may be laminated or otherwise treated to make the carton water-resistant, more durable, or to insulate the contents of the carton.

The blank 100 includes various panels that are hingedly connected along transverse fold lines. More specifically, the blank 100 includes a top panel 102, which is hingedly connected along transverse fold line 104 to a first side panel 106. The first side panel 106 is hingedly connected along transverse fold line 108 to a bottom panel 110. The bottom panel 110 is hingedly connected along transverse fold line 112 to a second side panel 114. The top panel 102 is hingedly connected to an edge flap 116 along transverse fold line 118. Those skilled in the art will readily appreciate that the edge flap 116 could be connected to the second side panel 114 instead. Additionally, it is possible to begin and end the sequence of primary panels differently, for instance, such that the bottom panel 110 is first, followed by the second side panel 114, the top panel 102, and then the first side panel 106.

The blank 100 also includes two end panels that are hingedly connected along longitudinal fold lines. More specifically, a first end panel 120 is hingedly connected along longitudinal fold line 122 to the bottom panel 110. A second end panel 124 is hingedly connected along longitudinal fold line 126 to an opposite end edge of the bottom panel 110.

Figure 4:
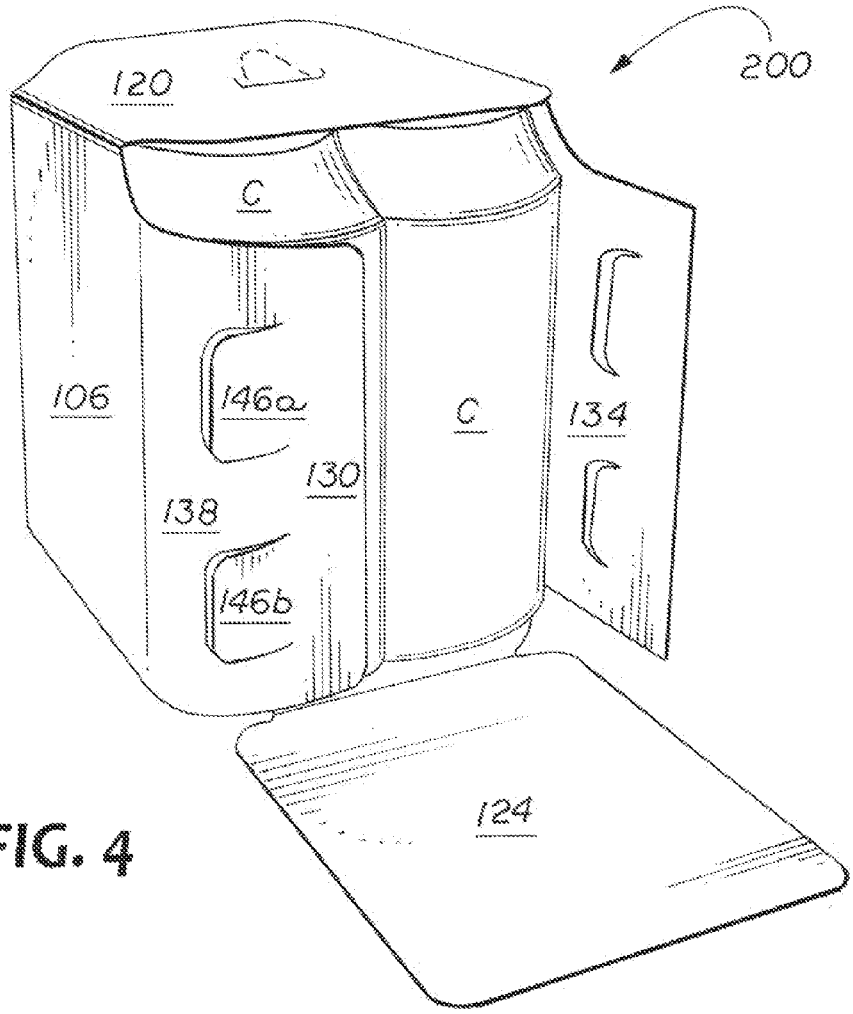
FIG. 4 is a partial perspective view of the carton of FIG. 2, showing curvature of the corner panels and alignment of a set of glue tabs with a glue strip prior to enclosing an end of the carton with an end panel.
Figure 5:
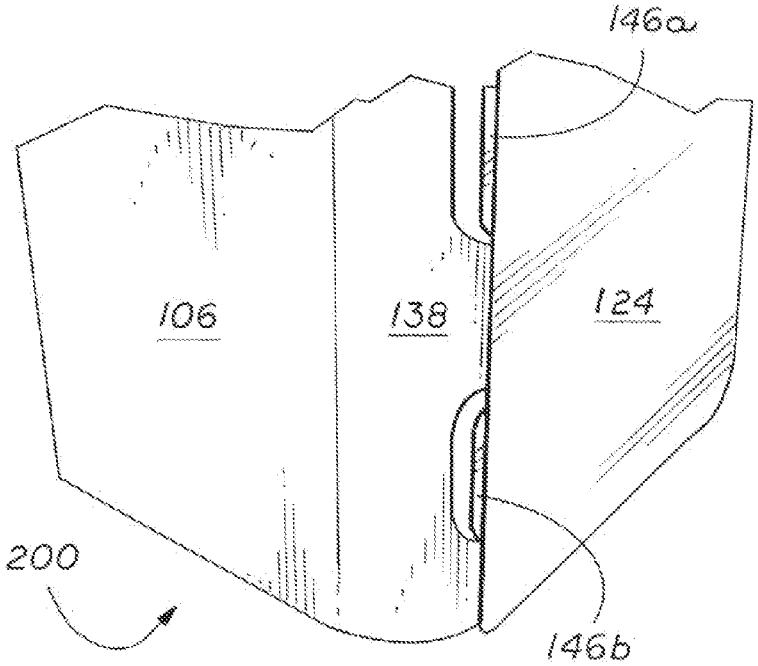
FIG. 5 is a partial perspective view of the carton of FIG. 2, showing the face contacting arrangement of the glue tabs with an end panel as the carton is closed.

Four glue strips 128, 130, 132, 134 extend from the distal edges of four corner panels 136, 138, 140, 142, which will define the corners of the erected carton 200, as best shown in FIGS. 4 and 5. Each of the glue strips 128, 130, 132, 134 includes a set of glue tabs 144*a*/144*b*, 146*a*/146*b*, 148*a*/148*b*, 150*a*/150*b*. Each of the glue strips 128, 130, 132, 134 is defined proximally by a fold line 152, 156, 160, 164 along which the glue strip 128, 130, 132, 134 is connected to one of the corner panels 136, 138, 140, 142. Each set of glue tabs 144*a*/144*b*, 146*a*/146*b*, 148*a*/148*b*, 150*a*/150*b* extends from and interrupts the respective fold line 152, 156, 160, 164 and partially across the respective corner panel 136, 138, 140, 142. In fact, each glue tab 144*a*, 144*b*, 146*a*, 146*b*, 148*a*, 148*b*, 150*a*, 150*b* is struck, or otherwise formed, at least in part from a corner panel 136, 138, 140, 142. Each corner panel 136, 138, 140, 142 is hingedly connected along the fold lines 154, 158, 162, 166 to a longitudinal edge of two of the side panels 106, 114.

The blank also include a finger aperture 168 (shown closed) that is defined in the top panel 102.

Figure 3:
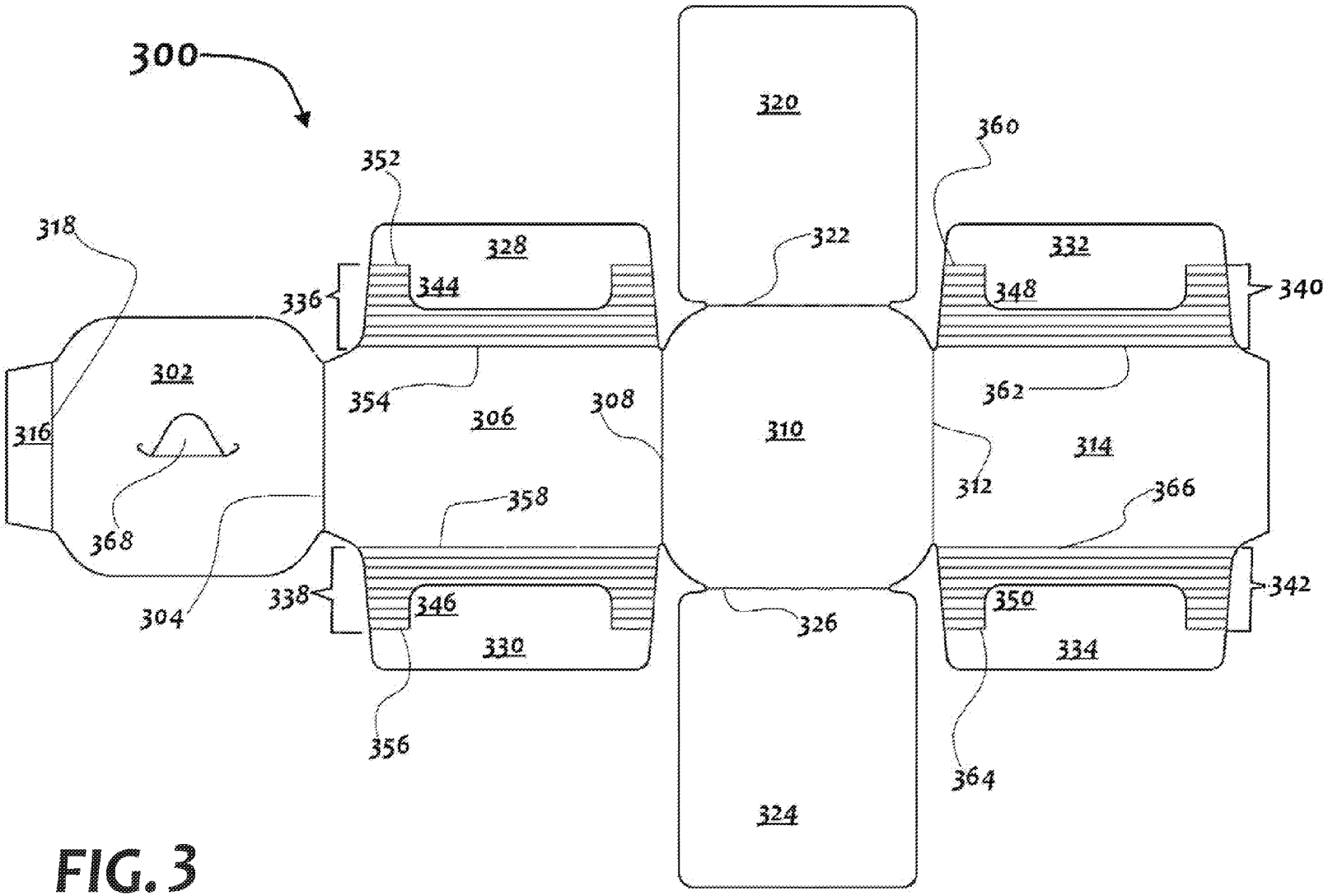
FIG. 3 is a plan view of an alternative embodiment of a carton blank, in accordance with the present invention.

FIG. 3 is a plan view of another exemplary embodiment, which demonstrates that there may be as few as one glue tab extending from the glue strip and onto an adjacent corner panel. Specifically, blank 300 includes four corner panels 336, 338, 340, 342, from a distal edge of which a glue strip 328, 330, 332, 334 extends along the fold lines 352, 356, 360, 364. Each glue strip 328, 330, 332, 334 includes a glue tab 344, 346, 348, 350 that is defined at least in part by a severance line that begins and ends at the respective fold line 352, 356, 360, 364, and that extends partially across the corner panel 336, 338, 340, 342. The remaining elements of the blank 300 are substantially identical to the corresponding element of the blank 100, and are distinguished only by use of the first digit "3".

Referring now to FIGS. 1 and 4-5, and for purposes of teaching and not of limitation, an exemplary method for erecting the carton 200 will now be described. Four containers C are placed on the inside surface of the bottom panel 110. Glue, double-sided tape, or any other suitable adhesive or connecting means such as VELCRO and the like, is applied to the edge flap 116, and the first side panel 106 is folded upward and to a right angle with respect to the bottom panel 110, such that the inside surface of the first side panel 106 is adjacent to and tangentially contacting the sides of two of the containers C. Possibly simultaneously, the second side panel 114 is folded upward similarly, and the top panel 102 is folded over the tops of the containers C, bringing the edge flap 116 into proximity of the second side panel 114. The edge flap 116 is folded downward and into flat face-contacting relation to the inside surface of the second side panel 114, such that it is secured thereto.

In this fashion, a tubular sleeve is formed, with the end panels 120, 124 still in the same plane as the bottom panel 110. It should be noted, however, that according to an alternative embodiment of a method for erecting the carton 200, the containers C could be loaded into the carton 200 at this point, instead of being pre-loaded. In other words, the tubular sleeve can be formed in advance by folding the edge flap 116 inward along fold line 118, depositing adhesive thereon, and then folding the entire blank 100 along fold line 108 so that the edge flap 116 is secured to the distal transverse edge of the second side panel 114. In these embodiments, the tubular sleeve can be stored or shipped in this flattened state, and the first and second side panels 106, 114 can be raised later to be parallel to one another, with the top panel 102 disposed above and parallel to the bottom panel 110.

In either case, once the tubular sleeve is formed and erected, and the containers have been loaded, the corner panels 136, 138, 140, 142 are curved around the containers C until the glue strips 128, 130, 132, 134 are aligned with the fold lines 122, 126, which define the opposed end edges of the bottom panel 110. As the corner panels 136, 138, 140, 142 are curved, each of the glue tabs 144*a*/144*b*, 146*a*/146*b*, 148*a*/148*b*, 150*a*/150*b* springs free of the adjacent corner panel 136, 138, 140, 142 and stays substantially in the plane of the primary portion of the glue strip 128, 130, 132, 134, as shown in FIG. 4. Glue G1, G2 is or has been applied to the glue receiving areas of the glue strips 128, 130, 132, 134, including the glue tabs 144*a*/144*b*, 146*a*/146*b*, 148*a*/148*b*, 150*a*/150*b*, and consequently, the glue strips 128, 130, 132, 134 adhere to the inside surface of the respective end panel 120, 124 when the end panels 120, 124 are subsequently raised out of the plane of the bottom panel 110 and into a flat face-contacting arrangement with the glue strips 128, 130, 132, 134 and into a tangentially contacting arrangement with the sides of the containers C now enclosed by the carton 200, as shown in FIG. 5.

Figure 2:
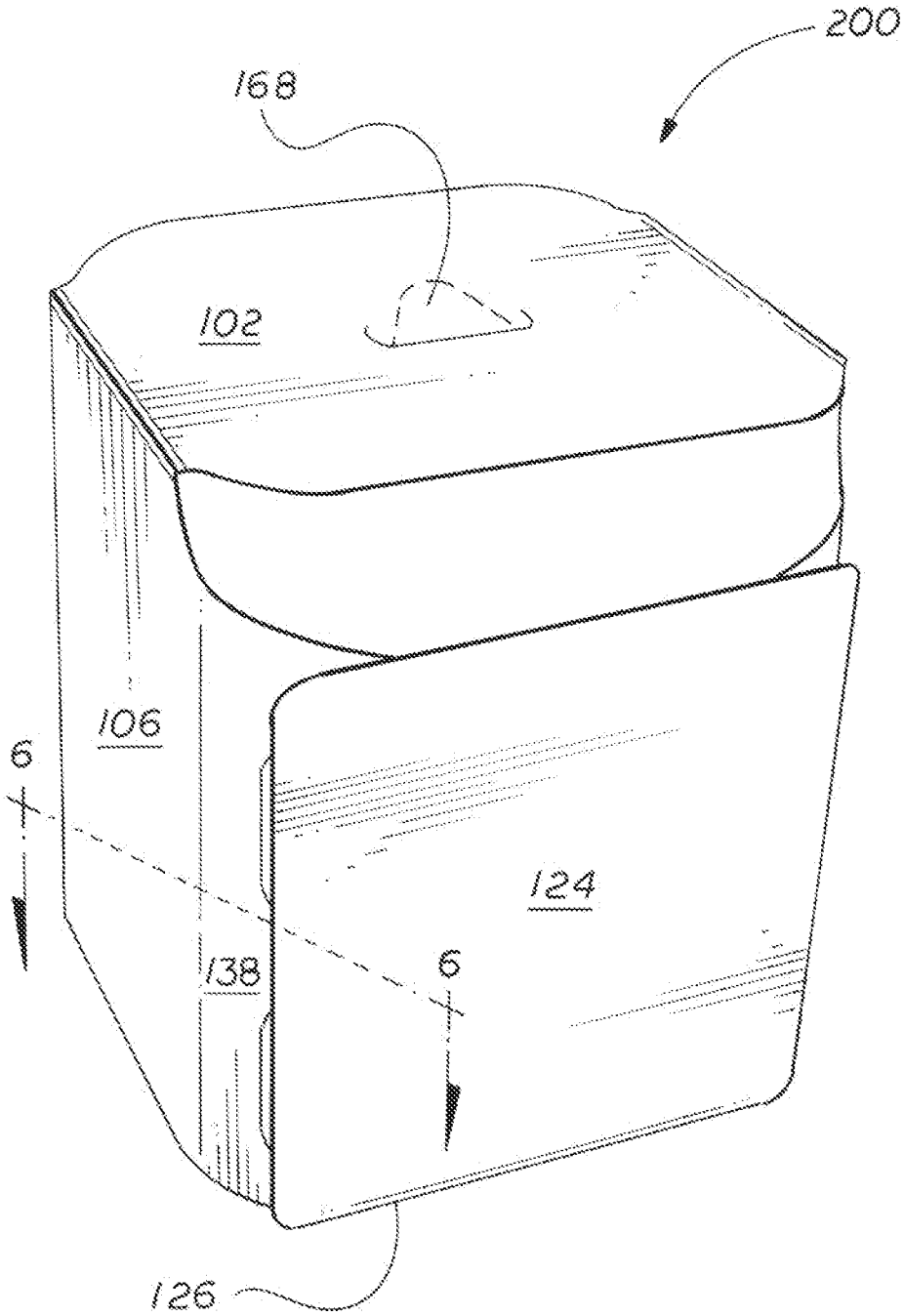
FIG. 2 is a perspective view of a carton formed from the blank of FIG. 1.
Figure 6:
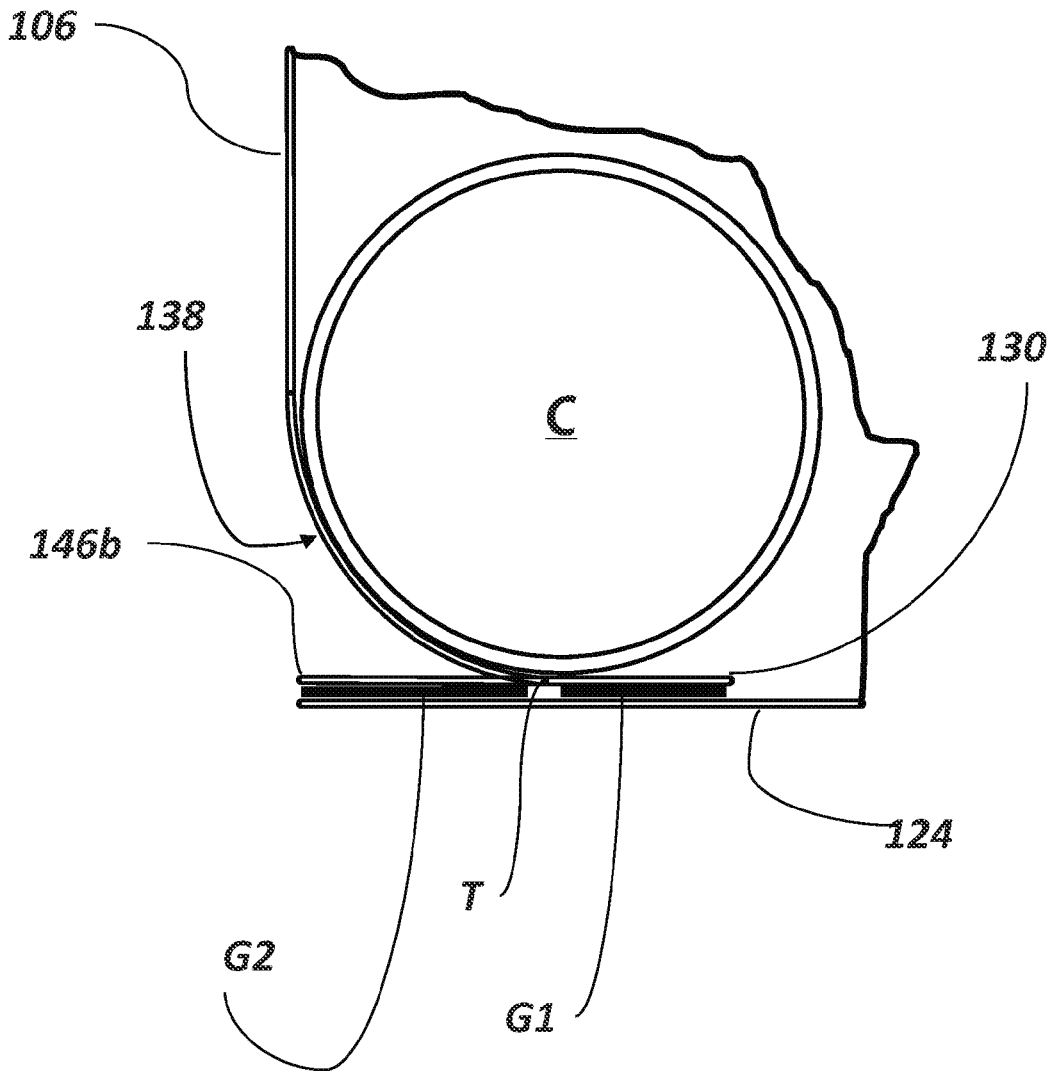
FIG. 6 is a partial cutaway view of the carton FIG. 2, taken along the line 6-6 showing curvature of the corner panels and alignment of a glue tab with a glue strip, and in face-contacting relation to an end panel.

To further illustrate the benefits and teachings of the invention, FIG. 6 is a partial cutaway view showing the section 6-6 shown in FIG. 2. The glue tabs 144*a*/144*b*, 146*a*/146*b*, 148*a*/148*b* of the present invention are particularly useful, because without them, the glue strips 128, 130, 132, 134 would be limited in the extent to which they are parallel and substantially linear with respect to an end panel 120, 124 to which they are to adhere. Thus, there would be two options (short of adding substantially more sheet material to increase the overlapping portions thereof)—either make do with only the glue receiving area G1, or apply additional adhesive and attempt to curve the end panels around the corner panels 136, 138, 140, 142. The former limits the strength of the join, and the latter is subject to delamination, as gluing two curved areas together is less secure than a flat join. The sheet material would tend to spring back into its original condition, which would delaminate that glued regions. So, the glue tabs of the present invention advantageously increase the effective surface area of the join without increasing the amount of sheet material used to form the blank 100. Specifically, the glue tab 146*b* shown in FIG. 6 is substantially parallel and in flat face-contacting relation to the end panel 124 and is in linear alignment with the rest of the glue strip 130, thus providing an ideal substrate for the application of additional adhesive to the glue receiving area G2. The glue tab 146*b* extends from the tangent point T, which may be aligned with the fold line 156 and defined by the tangential point of contact between the glue strip 130 with the side of the container C. It should be noted that the glue receiving areas G1 and G2 may be substantially continuous, although a space is shown between them for ease of showing the tangent point T.

The exemplary carton 200 can be erected from the exemplary blank 100 as described, although the steps can be performed in various sequences, some steps may be combined or omitted, and other alternative methods are contemplated. Those skilled in the art will readily appreciate that each blank 100 can be erected using automatic or manual means.

The present invention has been illustrated in relation to a particular embodiment which is intended in all respects to be illustrative rather than restrictive. Those skilled in the art will recognize that the present invention is capable of many modifications and variations without departing from the scope of the invention. For example, as used herein, directional references such as "top", "base", "bottom", "end", "side", "inner", "outer", "upper", "middle", "lower", "front" and "rear" do not limit the respective to such orientation, but merely serve to distinguish these panels from one another. Any reference to hinged connection should not be construed as necessarily referring to a single fold line only; indeed, it is envisaged that hinged connection can be formed from one or more of one of the following, a score line, a frangible line or a fold line, without departing from the scope of invention. Those skilled in the art will also appreciate that the article arrangement described is only one example of the various configurations that will be suitable for implementation of the various embodiments of the invention, including 2×N or N×N arrangements, where N is the number of articles in a column or row.

It should be understood that various changes may be made within the scope of the present invention, for example, the size and shape of the panels and apertures may be adjusted to accommodate containers of differing size or shape, and alternative shapes, sizes, and alternative configurations for interlocking bottom wall or handle elements may be used. The carton may accommodate one or more articles in different arrangements, including in various 2×N arrangements, where N is the number of articles on either side of the composite handle.

The invention claimed is:

1. A carton, comprising a bottom panel for supporting ends of substantially cylindrical articles;

four side panels;

at least one corner panel connected to one of opposed edges of a first one of the four side panels along a first fold line; and at least one glue strip connected to the at least one corner panel along a second fold line which defines a proximal edge of the at least one glue strip, the at least one glue strip comprising at least one glue tab extending from the proximal edge of the at least one glue strip such that the at least one glue tab interrupts the second fold line;

wherein the at least one glue tab is secured in a face contacting arrangement to a second one of the four side panels so as to connect the first one of the four side panels to the second one of the four side panels, and wherein the at least one glue tab is struck from the at least one corner panel such that the at least one glue tab is formed at least in part from part of the at least one corner panel between the first and second fold lines.

2. The carton of claim 1, wherein the at least one corner panel is formed such that a horizontal cross section of the at least one corner panel is substantially arcuate in shape, the curvature of the at least one corner panel being selected to approximate the curvature of a substantially cylindrical article.

3. The carton of claim 1, wherein the at least one glue tab extends linearly from the at least one glue strip such that the at least one glue tab lies in a plane of the at least one glue strip and is parallel to the second one of the four side panels.

4. The carton of claim 1, wherein the at least one glue tab comprises a single glue tab.

5. The carton of claim 1, wherein the at least one glue tab comprises a plurality of glue tabs.

6. The carton of claim 1, wherein the at least one glue tab has rounded corners.

7. The carton of claim 1, wherein the at least one corner panel comprises a pair of corner panels hingedly connected respectively to the opposed edges of the first one of the four side panels.

8. The carton of claim 1, wherein the at least one corner panel comprises a first corner panel extending from the one of the opposed edges of the first one of the four side panels, and wherein the carton further comprises a second corner panel extending from one of opposed edges of a third one of the four side panels, the first and third side panels being disposed in an opposed parallel relationship.

9. The carton of claim 8, wherein at least one glue strip extends from the second corner panel, wherein the at least one glue strip of the second corner panel comprises at least one glue tab extending from a proximal edge of the at least one glue strip of the second corner panel, and wherein the at least one glue tab of the second corner panel is secured in a face contacting arrangement to the second one of the four side panels so as to connect the third one of the four side panels to the second one of the four side panels.

10. A blank for forming a carton for enclosing substantially cylindrical articles, comprising:

a bottom panel;

four side panels hingedly connected to the bottom panel;

at least one corner panel hingedly connected to a first one of the four side panels along a first fold line; and at least one glue strip hingedly connected along a second fold line to the at least one corner panel, the at least one glue strip comprising at least one glue tab, and the at the at least one glue tab is struck at least in part from the at least one corner panel such that the at least one glue tab extends into the at least one corner panel.

11. The blank of claim 10, wherein the at least one glue tab extends from the second fold line such that the at least one glue tab interrupts the second fold line.

12. The blank of claim 11, wherein the at least one glue tab extends at least partially across the at least one corner panel toward the first one of the side panels.

13. The blank of claim 10, wherein the at least one corner panel comprises a pair of corner panels hingedly connected respectively to opposed edges of the first one of the four side panels.

14. A carton, comprising a bottom panel for supporting ends of substantially cylindrical articles;

four side panels;

at least one corner panel connected to one of opposed edges of a first one of the four side panels along a first fold line; and at least one glue strip connected to the at least one corner panel along a second fold line which defines a proximal edge of the at least one glue strip, the at least one glue strip comprising at least one glue tab extending from the proximal edge of the at least one glue strip such that the at least one glue tab interrupts the second fold line;

wherein the at least one glue tab is secured in a face contacting arrangement to a second one of the four side panels so as to connect the first one of the four side panels to the second one of the four side panels, and wherein the at least one glue tab extends from the proximal edge of the at least one glue strip to a free end of the at least one glue tab, the free end being closer to the first fold line than the proximal edge.

15. The blank of claim 10, wherein the at least one glue tab extends from the second fold line to a free end of the at least one glue tab, the free end being closer to the first fold line than the proximal edge.

16. The blank of claim 15, wherein the at least one glue tab extends from the second fold line toward the first one of the four side panels.

* * * * *